US005357740A

United States Patent [19]

Moreland

[11] Patent Number: 5,357,740

[45] Date of Patent: Oct. 25, 1994

[54] AIR SPLICING DEVICE AND METHOD

[76] Inventor: Darron Moreland, 1009 Foster St., Dalton, Ga. 30721

[21] Appl. No.: 64,761

[22] Filed: May 19, 1993

Related U.S. Application Data

[63] Continuation of Ser. No. 727,577, Jul. 9, 1991, abandoned.

[51] Int. Cl.[5] ..... D01H 15/00

[52] U.S. Cl. ..... 57/22

[58] Field of Search ..... 57/22, 23, 350

[56] References Cited

U.S. PATENT DOCUMENTS

| | | | |
|---|---|---|---|
| 3,581,486 | 6/1971 | Dibble | 57/22 |
| 4,441,308 | 4/1984 | Rohner et al. | 57/22 |
| 4,452,035 | 6/1984 | Rohner et al. | 57/22 |
| 4,555,899 | 12/1985 | Mima | 57/22 |
| 4,751,813 | 6/1988 | Clayton et al. | 57/22 |
| 4,757,676 | 7/1988 | Clayton | 57/22 |
| 4,788,814 | 12/1988 | Crouch et al. | 57/22 |
| 4,796,418 | 1/1988 | Rebsamen et al. | 57/22 |
| 4,803,833 | 2/1989 | Uchihara | 57/22 |
| 4,825,630 | 4/1989 | Czelusniak, Jr. et al. | 57/22 |
| 4,833,872 | 5/1989 | Czelusniak, Jr. et al. | 57/22 |
| 4,852,339 | 8/1989 | Premi | 57/22 |
| 4,936,084 | 6/1990 | Matsui et al. | 57/22 |
| 4,938,013 | 7/1990 | Zumfeld | 57/22 |
| 4,999,891 | 3/1991 | Bankar | 57/22 X |

FOREIGN PATENT DOCUMENTS

| | | |
|---|---|---|
| 3528619A | 2/1987 | Fed. Rep. of Germany . |
| 3536580A1 | 4/1987 | Fed. Rep. of Germany . |
| 2-56381 | 8/1988 | Japan . |

OTHER PUBLICATIONS

"Mesdan Air Splicer Customer Assistance Manual" published by Mill Devices Company of A. B. Carter, Inc. no publication date available.

*Primary Examiner*—Joseph J. Hail, III

[57] ABSTRACT

A device and method for splicing yarns. The device includes a single passageway through which pressurized air is supplied to a splicing chamber dimensioned so as to cause turbulent air flow within the chamber when pressurized air is introduced. The device may also include a slot for quickly and easily feeding the yarns into the splicing chamber. A blade may be secured within the device to sever the yarns and provide a sufficiently short and uniform tail that will be accepted by needles conventionally used in the carpet manufacturing machinery.

4 Claims, 4 Drawing Sheets

AIR SPLICING DEVICE AND METHOD

This is a continuation of application Ser. No. 07/727,577, filed Jul. 9, 1991 now abandoned.

TECHNICAL FIELD

The present invention relates to an air splicing device and method. In particular, the invention pertains to a hand-held splicing device and method for splicing yarn by using pressurized air.

BACKGROUND OF THE INVENTION

Many types of splicing devices have been used in the carpet manufacturing industry to join one yarn package to another when textile machinery requires a continuous supply of yarn. One machine that requires a continuous yarn supply is a carpet tufting machine for manufacturing pile carpet. The tufting machine has creels associated therewith, and the creels use several pairs of yarn packages. The creel uses and depletes the first package and then uses the second package. Typically, an operator splices the trailing end of the first package to the leading end of the second package to provide the creel with a continuous supply of yarn.

Continuous operation of the carpet manufacturing machinery results in maximum production of the machines and ultimately maximum profit. When the carpet manufacturing machines are not operating, the carpet manufacturing company loses both productivity and money. The continued operation of the tufting machine depends, in part, on a continuous supply of yarn. Thus, the timely and effective splicing of yarn supply packages directly impacts the productivity of the carpet manufacturing process.

Splicing the yarns quickly and effectively is important for the continued operation of the tufting machinery. A tufting operator is responsible for providing a continuous yarn supply to the machinery. The operator makes sure that several yarn packages are continuously available for feeding into the machines. During normal operation, the operator may be splicing up to fourteen (14) yarn packages per minute. Thus, it is important to minimize the splicing time.

In addition to timeliness, it is also important that the splice be small, yet effective. Initially, weaver's knots were used as a method to join the leading and trailing yarn packages. When done properly a weaver's knot is sufficiently small and effectively holds the two yarn pieces together for most applications. Where many needles are used in a small area, yarn spliced by weaver's knots will not feed through the needles. In addition, the formation of a weaver's knot requires considerable manual dexterity and, if done continuously for a prolonged period of time, can cause pain and fatigue in the worker's hands and arms. Moreover, the free ends of a weaver's knot are of inconsistent length. If the free ends are too long, they may not properly feed into the machine and thus cause the machine to shut down. In addition, too much time would be required to cut the free ends of the weaver's knot to a consistent length.

Turning now to prior art splicing devices, all of the cited hand-held air splicing devices have been designed to include multiple nozzles that provide pressurized air to a splicing chamber. Moreover, the prior art requires that the yarns be manually fed into the devices. This process is cumbersome, time consuming and requires precision and significant coordination on the part of the operator.

Czelusniak et al. (U.S. Pat. Nos. 4,833,872 and 4,825,630) disclose methods and devices for air splicing yarn. The claimed devices include a cylindrical housing having an axial passageway and an open center. In addition, the Czelusniak devices include a pressurized air source connected to the housing. A circular channel, enclosed within the housing, is connected to the air source. A series of small passageways extends radially inward from the circular channel. The passageways are arranged at an angle from the center of the device so as to cause the pressurized air to move in a circular manner.

Crouch et al. (U.S. Pat. No. 4,788,814) discloses a manually operated air splicing device that is mounted near a textile winder. The device includes a cylindrical passageway, a pressurized air supply, an air channel, inwardly extending passageways connecting the channel to the passageway and a spring loaded arm to supply pressurized air to the channel. To operate, the user feeds both yarn pieces in the passageway and presses the arm to supply pressurized air to the passageway. The air creates a turbulent effect as it moves through the channel and into the passageways to splice the yarn pieces together.

The prior art devices and methods discussed above are undesirable for several reasons. All require the operator to manually feed the yarn pieces to be spliced into one end of the device. This requires considerable time and coordination of the operator. In addition, manually fed yarns often get misled. A splice that is misfed may be weak and break apart. A misfed splice may also have a longer tail which would fail to pass through the tufting needles and cause the machines to shut down. Moreover, the multiple passageways must have smaller diameters in order to deliver high pressure air to the splicing chamber. The smaller diameter passageways tend to clog when dust, dirt, oil and moisture particles enter the air system. A clogged passageway renders the device inoperable and requires the user to clear the passageway. To prevent the reoccurrence of a clogged passageway, the prior art devices are often used with an air filtration unit.

In addition, the prior art devices cited create splices that are often too large to fit through the tufting needles. When this occurs, the machine shuts down and requires rethreading before starting up again. Thus, a small splice is desired to ensure that the splice will easily pass through the tufting needles and prevent shut down problems with the tufting machinery.

It has also been found that the prior art devices ineffectively splice polypropylene yarns. Polypropylene yarn is a higher quality material used in the carpet industry today. Due to the quality and cost of polypropylene, carpet manufacturers want to use it as often as possible. If the availability of air splicing devices presently on the market cannot effectively splice polypropylene fibers, carpet manufacturers will be limited in the production of polypropylene carpet. A device that effectively splices a polyprophylene yarns would enable carpet manufacturers to produce a greater volume of higher quality carpet.

Thus, there is a need for an air splicing device and method that introduces pressurized air into a splicing chamber at a single location. There is a further need for an air splicing device and method that provides for larger air passageways through which pressurized air travels.

There is yet a further need for an air splicing device and method that does not require an air filtering device.

There is yet a further need for an air splicing device and method that does not clog when particles are introduced into the air system.

There is still a further need for an air splicing device and method that automatically feeds the yarn into the device.

There is yet a further need for an air splicing device and method that severs the yarn while it is within the device.

There is still a further need for an air splicing and device that effectively splices polypropylene yarns.

There is still a further need for an air splicing device and method that consistently produces splices of the same length.

There is still a further need for an air splicing device and method that consistently produces a sufficiently small splice capable of passing through needles used in carpet manufacturing machinery.

SUMMARY OF THE INVENTION

The present invention is an air splicing device and method having a single passageway that provides pressurized air into a chamber for splicing yarns. The device includes a housing, a passageway and a splicing chamber. A blade may be secured within the splicer housing to sever the ends of the splice. Moreover, a slot may be provided within the splicer housing to automatically feed the yarns into the chamber.

Thus, it is an object of the present invention to provide a new and improved air splicing device and method.

It is further object of the present invention to provide an air splicing device and method that uses a single passageway to supply pressurized air into the splicing chamber at a single location.

It is yet a further object of the present invention to provide an air splicing device and method that does not become inoperative when dirt, dust, oil and water particles enter the air system.

It is yet a further object of the present invention to provide an air splicing device and method that does not require an air filtering device.

It is yet a further object of the present invention to provide an air splicing device and method that automatically feeds the yarn into the device for splicing.

It is yet a further object of the present invention to provide an air splicing device and method that severs the yarn while it is within the device.

It is yet a further object of the present invention to provide an air splicing device and method that effectively splices polypropylene yarns.

It is yet a further object of the present invention to provide a method that consistently produces splices of the same length.

It is yet a further object of the present invention to provide a method that produces effective yet sufficiently small splices capable of passing through conventional carpet needles used in carpet manufacturing machinery.

Other objects, features and advantages of the present invention will become apparent upon reading the following detailed description of the embodiments of the invention, when taken in conjunction with the drawings and appended claims.

BRIEF DESCRIPTION OF THE DRAWING

The invention will now be described with reference to the accompanying drawings, which illustrate a preferred embodiment of the air splicing device and method, falling within the scope of the appended claims, and in which:

DETAILED DESCRIPTION OF THE DISCLOSED EMBODIMENTS

Figure 1:
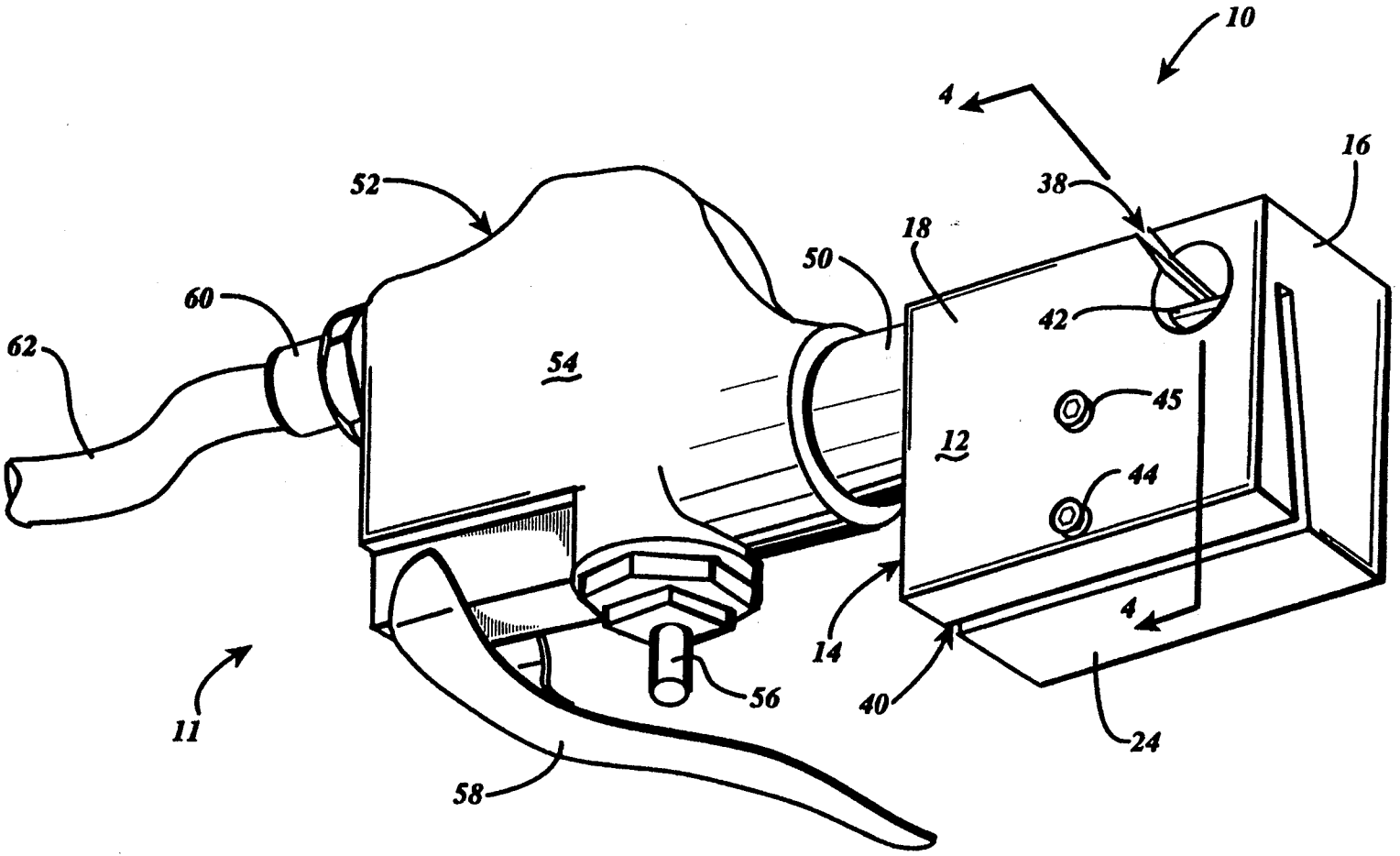
FIG. 1 is a perspective view shown in conjunction with a pressurized air supply of the preferred embodiment.
Figure 2:
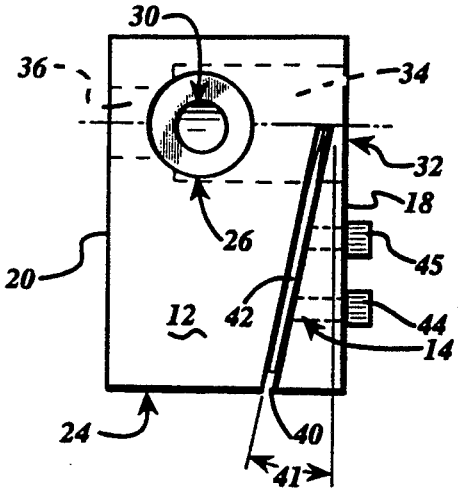
FIG. 2 is a rear view of the preferred embodiment.

Referring now in more detail to FIG. 1 which provides an overall view of the device 10 in conjunction with a pressurized air system 11. The device 10 includes a rectangular block 12 having six surfaces: rear 14, front 16, right 18, left 20, top 22 and bottom 24. An air passageway 26 begins at the rear surface 14 of the block 12 and extends inwardly at a perpendicular angle to the rear surface as shown in FIG. 2. The air passageway 26 has a first passageway section 28 and a second passageway section 30, shown in FIG. 3. The first passageway section 28 is adjacent to the rear surface 14 and is threaded for use with a pipe connector, discussed in more detail below. The second passageway section 30 extends concentrically inward from the first passageway section 28, but does not extend through the block 12 to the front surface 16.

Figure 4:
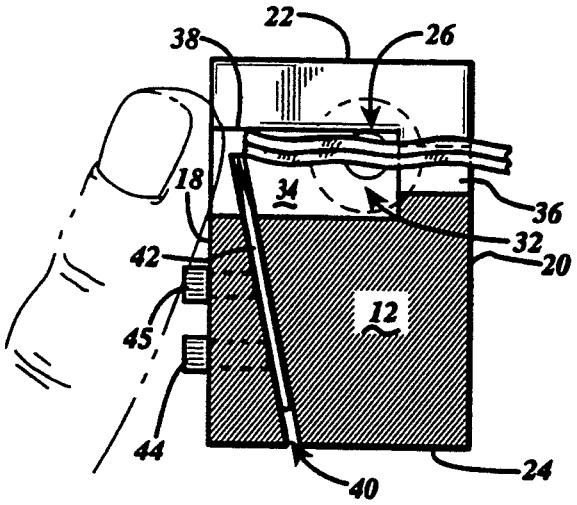
FIG. 4 is a rear cut away view of the preferred embodiment.

The air passageway 26 perpendicularly intersects a splicing chamber 32. The chamber 32 extends from the right surface 18 to the left surface 20 as best shown in FIG. 4. The chamber 32 includes a first chamber section 34 and a second chamber section 36. The first chamber section 34 originates on the fight surface 18 of the block 12 and extends perpendicularly inward therefrom. The second chamber section 36 extends concentrically inward from the first chamber section 34 through to the left surface 20.

Figure 3:
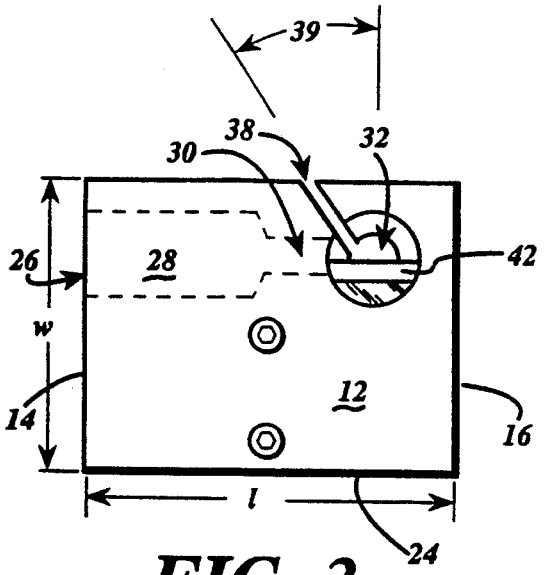
FIG. 3 is a right side view of the preferred embodiment.
Figure 5:
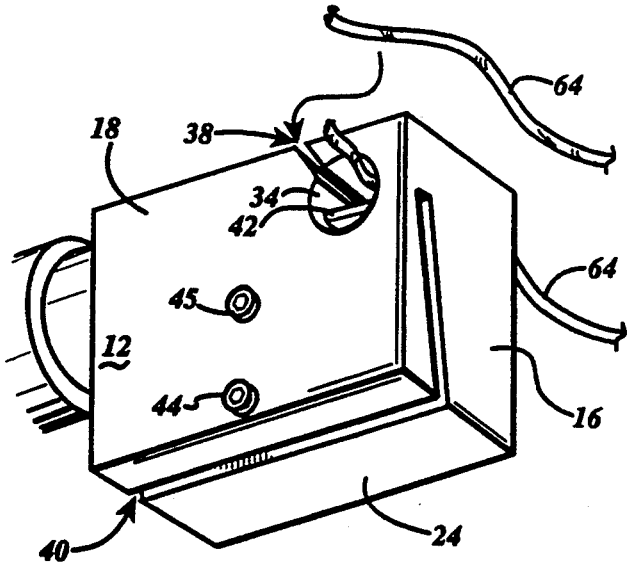
FIG. 5 is a detailed view of the preferred embodiment shown in conjunction with yarns to be spliced.

A feeder slot 38 extends along the length of the splicing chamber 32 up to and through the top surface 22, as best shown in FIG. 3. A blade slot 40, shown in FIG. 4, originates along the length of the bottom surface 24 and extends inwardly into the splicing chamber 32. The blade slot 40 receives a blade 42 which is held in place by bolts 44, 45 fastened to the block 12, as shown in FIG. 5.

Turning now to the pressurized air system 11, as shown in FIG. 1, the system includes a first pipe connector 50, such as a nipple, threaded into the first passageway section 28 of the block 12. A manually operated valve 52 is secured to the first connector 50. The valve 52 has a body 54, a spring loaded actuator 56 and a lever 58 hinged to the valve body and proximately located to the actuator. A second pipe connector 60 is attached at the other end of the valve body 54 and to a high pressure air line 62.

To operate, the user holds the device 10 which is attached to the air system 11 and grabs yarn pieces 64 for splicing in the other hand. The user applies slight tension to the yarns 64 so as to cause a portion of the yarn length to pass through the feeder slot 38 and into the splicing chamber 32. The user applies downward tension on the yarns 62 so they pass over the blade 42 and are severed. The severed pieces of yarn 64 are removed and discarded.

Figure 7A:
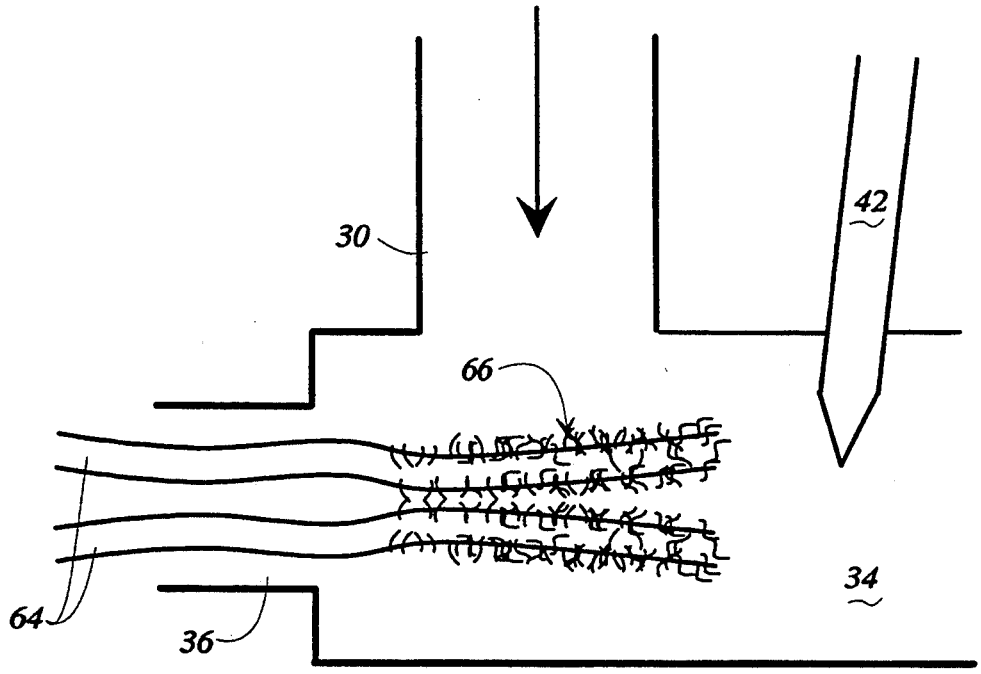
FIGS. 7A and 7B are illustrative views of the operation of the preferred embodiment.
Figure 7B:
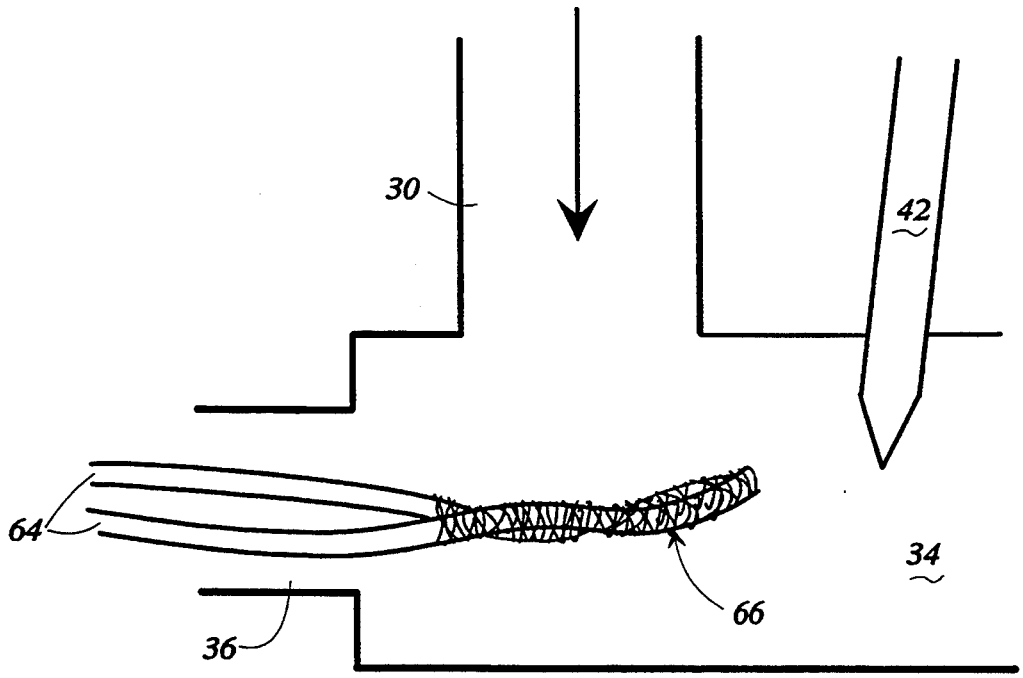

Still maintaining the yarns 64 within the splicing chamber 32, the operator applies pressure to the valve lever 58 which causes the lever to press down on the spring loaded actuator 56 which, in turn, causes the valve to open. Pressurized air enters the passageway 26 and travels to the chamber 32. As the pressurized air hits the splicing chamber 32, it breaks up the yarns 64 into a plurality of fibers 66 as shown in FIG. 7A. The pressurized air travels down the second chamber section 36 and out of the block 12. The smaller diameter of the second chamber section 36 in combination with the blade partially blocking the first chamber section 34 causes the air to travel out of the second chamber section 36, thus enabling the fibers 66 to intertwine and form an effective splice as shown in FIG. 7B.

Figure 6:
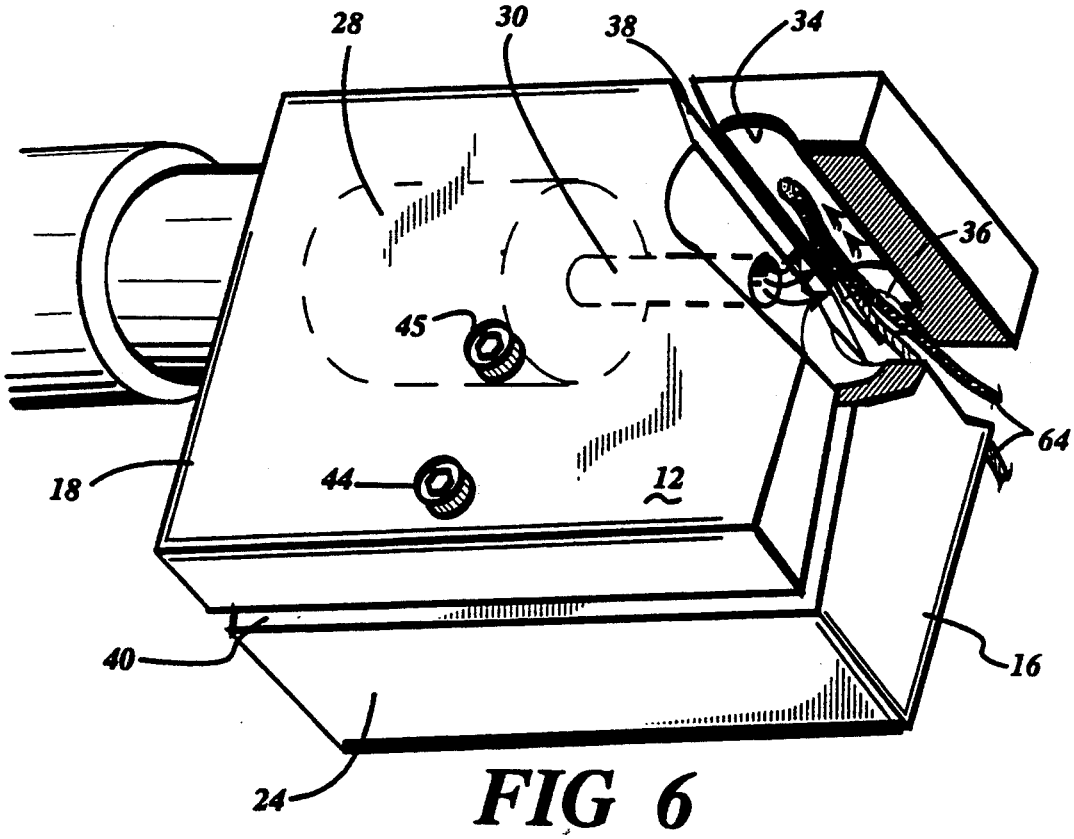
FIG. 6 is a cross-sectional view of the preferred embodiment during operation.

It is preferred that the user's finger be placed over the entrance to the first chamber section 34 when air is supplied to the chamber 32 as shown in FIG. 6, so as to further ensure that the air will exit to the left surface 20. It is also preferred that the block 12 be comprised of aluminum. However, other materials having similar material properties are contemplated. Moreover, it is suggested that the corners of the block be rounded so as to avoid injury.

The width w of the block 12 is preferably 1 17/64 and the length l is preferably 1 41/64 inches. The second passageway section is preferably 5/32 inches in diameter and 5/16 inches in length. The first chamber section 34 is preferably $\frac{3}{8}$ inches in diameter and $\frac{5}{8}$ inches in length. The second chamber section 36 is preferably 5/32 inches in diameter and 7/32 inches in length.

The angle 39 of the feeder slot 38 is preferably arranged at 56° angle measured counterclockwise from the vertical extending perpendicular from the top surface 22. The angle 41 of the blade slot 40 is preferably arranged at a 79° angle measured clockwise from a horizontal plane parallel to the bottom surface 24. It is preferred that the blade 42 extend to the center line of the splicing chamber 32. Both the feeder and blade slots 38, 40, respectively, are preferably 0.062 inches wide. These dimensions have been found to achieve maximum performance for the device when air pressurized between 70 and 120 psi is used. In that range, the passageway and chamber volumes create the optimum atmosphere for producing effective splices. However, the width of the feeder slot 38 may be altered to conform to different sized yarns used in the carpet manufacturing process.

In addition, it is preferred that the longitudinal axes of the passageway and chamber axes be perpendicular to each other. It has been found that the most effective splice is achieved when the direction of air travel is perpendicular to the chamber wall where it hits. At this initial impact angle, the yarns break up most effectively into discrete fibers as shown in FIG. 7A.

The relative dimensions of the chamber sections help to cause the yarns to mutually interwine as shown in FIG. 7B. The blockage of the first chamber section 34 by both the user's finger and the blade also help to force the air to travel out the second chamber section 36. If the dimensions are kept proportional, the device may be enlarged or reduced to accomodate specific applicatons.

The total chamber length and location of the blade also impact the splice length. The splice length must be minimized so as to easily travel trough the tufting needles and other carpet manufacturing machinery.

It will be appreciated that the embodiment discussed above is the preferred embodiment, and the various alternative embodiments are contemplated, falling within the scope of the appended claims. For example, positional adjectives such as left, fight, top, bottom, front and rear are used for the sole purpose of describing the interrelationship of the various elements of the inventions and are no way intended to limit the scope of the invention. A cylindrically-shaped embodiment is also contemplated, where the passageway extends along a portion of the length of the cylinder, and the chamber extends radially through the cylinder. It is also contemplated that the splicing chamber 32 may be designed so as to be interchangeable with the other elements of the device. It is envisioned that a piece of material be designed to be inserted into the body 12 so as to enable the device 10 to have interchangeable splicing chambers of various sizes. Other orientations of the invention are contemplated.

It will be further appreciated that the invention described herein operates equally effectively on other types of materials such as thread. Thus, the present invention is not limited to the carpet industry but may be used throughout the textile industry.

I claim:

1. A splicing device comprising:

a splicing chamber for receipt of high pressure fluid and for receipt of parallel, and unidirectional oriented lengths of yarn, the splicing chamber having a longitudinal axis joining first and second ends of the chamber, a chamber exterior, and a chamber interior;

one and only one chamber inlet located substantially perpendicular to the chamber longitudinal axis, through which high pressure fluid is introduced into the chamber;

a chamber outlet through which high pressure fluid is discharged from the interior of the chamber, the outlet being substantially perpendicular to the chamber inlet;

means for introducing high pressure fluid into the chamber interior at a single location;

a single yarn receiver to operatively and simultaneously admit the plurality of yarn lengths to the interior of the splicing chamber so that the yarn lengths are oriented within the splicing chamber interior in a unidirectional manner; and a severing means that extends into the interior of the splicing chamber, whereby as the high pressure fluid is discharged from the chamber, it causes the yarn length fibers to mutually intertwine and form a splice.

2. A splicing device comprising:

a body, capable of connection with a pressurized fluid source, the body having an exterior, an interior and a longitudinal axis;

one and only one passageway for connecting the pressurized fluid source with the body, the passageway extending inwardly parallel to the longitudinal axis of the body for a portion of the length of the body, the passageway having a longitudinal axis;

a chamber having a longitudinal axis and extending through the body, the chamber longitudinal axis being perpendicular to and in communication with the passageway for receipt of high pressure fluid at a single location and parallel, unidirectionally oriented lengths of yarn, and a slot to operatively and simultaneously admit a plurality of unidirectionally oriented yarn lengths into the splicing chamber;

a slot to operatively and simultaneously admit a plurality of unidirectionally oriented yarn lengths into the splicing chamber; and a blade for severing yarns while the yarns are located within the chamber, the blade being secured to the body and extending inwardly from the body surface to the center line of the chamber.

3. A method for splicing yarns comprising the steps of;

arranging a plurality of yarn lengths parallel and unidirectionally;

simultaneously inserting the yarn lengths by guiding the yarn lengths into a splicing chamber, the chamber having an inlet and an outlet, through a single slot in communication with the chamber, the chamber having a longitudinal axis joining first and second ends of the chamber, the chamber inlet located substantially perpendicular to the chamber longitudinal axis, and the chamber outlet being substantially perpendicular to the chamber inlet;

introducing high pressure fluid through the chamber inlet at a single location;

causing the yarn lengths to break up into discrete fibers; and simultaneously causing high pressure fluid to discharge through the chamber outlet, whereby high pressure fluid travels through the splicing chamber causing the fibers and yarn lengths to intertwine and form a splice.

4. The method of claim 3 further comprising the step of severing the yarn lengths while the yarn lengths are located within the chamber.

* * * * *